United States Patent [19]

Jacquet

[11] Patent Number: 4,859,979

[45] Date of Patent: Aug. 22, 1989

[54] THERMAL RELAY

[75] Inventor: Bruno Jacquet, Saint Germain en Laye, France

[73] Assignee: La Telemecanique Electrique, France

[21] Appl. No.: 216,479

[22] Filed: Jul. 8, 1988

[30] Foreign Application Priority Data

Aug. 7, 1987 [FR] France ..... 87 09676

[51] Int. Cl.[4] ..... H01H 37/00; H01H 71/16; H01H 61/00

[52] U.S. Cl. ..... 337/3; 337/49; 335/6

[58] Field of Search ..... 337/3, 6, 4, 49; 335/6

[56] References Cited

U.S. PATENT DOCUMENTS 3,638,157 1/1972 Kruzic ..... 337/6
4,528,539 7/1985 Forsell et al. ..... 337/49
4,635,020 1/1987 Sako ..... 337/49
4,670,728 6/1987 Akiike et al. ..... 337/49

*Primary Examiner*—H. Broome
*Attorney, Agent, or Firm*—William A. Drucker

[57] ABSTRACT

A thermal relay is provided comprising, in a first cavity of a case, bi-metallic strips through which pass currents of a multi-phase network feeding a load through an electromagnetic contactor and, in a second cavity, an electromagnetic sub-assembly including break and signalling switches whose mobile contacts have pivoting axes and actuating points cooperating with a common piece, the whole forming a deformable parallelogram. The second cavity also contains toggle transmission means between the bi-metallic strips and said common piece as well as means for selecting the mode of operation of the switches. Toggle springs are associated with said mobile contacts.

4 Claims, 2 Drawing Sheets

THERMAL RELAY

BACKGROUND OF THE INVENTION

1. Field of the Invention

The invention relates to a thermal relay comprising a plurality of bi-metallic strips housed in a first cavity of a case and heated by currents from a multi-phase network which feed a load, and which flow through a separate electromagnetic contactor placed in series, these bi-metallic strips acting, when these currents exceed a certain threshold for an extended period, on a quick break switch placed in series with the coil of the contactor and, on the other hand, means for transmitting and selecting the operating mode of this switch between two quick break working modes, one of which is provided with automatic re-make and the other with manual re-make, this switch and these means being placed in an electromechanical sub-assembly adapted for being housed in a second cavity of the case.

2. Description of the Prior Art

Such thermal relays which are widely used in circuits feeding multi-phase motors, whose protection they ensure should extended overloads appear, may be illustrated by the French patent No. 2 536 906 of the Applicant.

In this known apparatus, whose size and function do not necessarily imply that it is incorporated in a complex automated system, a single switch is disposed in a removable sub-assembly.

It is known that, in some known thermal relays, a second quick make switch is associated with the transmission means which actuate the break switch so as to show the appearance of a fault through its incorporation in a signalling circuit which is electrically independent of the one concerning the coil of the contactor.

If it is desired that such a signalling function is accomplished by an electromechanical sub-assembly such as the one defined above, its volume is necessarily increased and the problem arises of not overloading the transmission mechanism so as to preserve its sensitivity properties which constitutes its advantage. It is moreover frequently required that the electric signalling, which may be communicated remotely through conductors of great length, is accompanied by local optical signalling which also shows the appearance of a fault, and that local manual control means are provided for checking the correct operation of the switch or switches by mechanically simulating the appearance of a current fault.

SUMMARY OF THE INVENTION

The invention proposes making improvements to a thermal relay sub-assembly whose construction corresponds to the one mentioned above, which are adapted so that it preserves its relatively reduced dimensions, while not introducing appreciable additional friction when incorporating a signalling make switch and further offering, on assembly, a great simplicity of dimensional and visual control.

The invention achieves this result through the fact that, parallel to the dividing wall supporting in its upper region a first pair of terminals associated with the break switch and a second pair of terminals associated with the signalling switch, are disposed the two mobile contact pieces of these switches which have pivoting axes and actuation points receiving the thrusts and relaxations of a common mobile piece, forming substantially a deformable parallelogram in which the two toggle springs are simultaneously actuated, one tensioned and the other relaxed, at the time of tripping.

BRIEF DESCRIPTION OF THE DRAWINGS

The invention, as well as other measures adapted for conferring great ease of mounting on the bare sub-assembly and on the thermal relay a strict arrangement of its different components, will be better understood from the following description, with reference to the eight accompanying figures which illustrate:

FIG. 5, a side view of the thermal relay showing a preferred arrangement and location of the removable subassembly supporting the contact assembly;

FIG. 6, a rear view of the thermal relay showing members placed on a rear face of a dividing wall of the sub-assembly;

FIG. 7, a rear view of the sub-assembly showing quick trip and adjustment transmission elements which are superimposed on those of FIG. 6; and FIG. 8, a partial perspective view of a portion of the case of the relay showing the cavity receiving the sub-assembly and details of shapes adapted for cooperating with terminal pieces.

DESCRIPTION OF THE PREFERRED EMBODIMENTS

Figure 1:
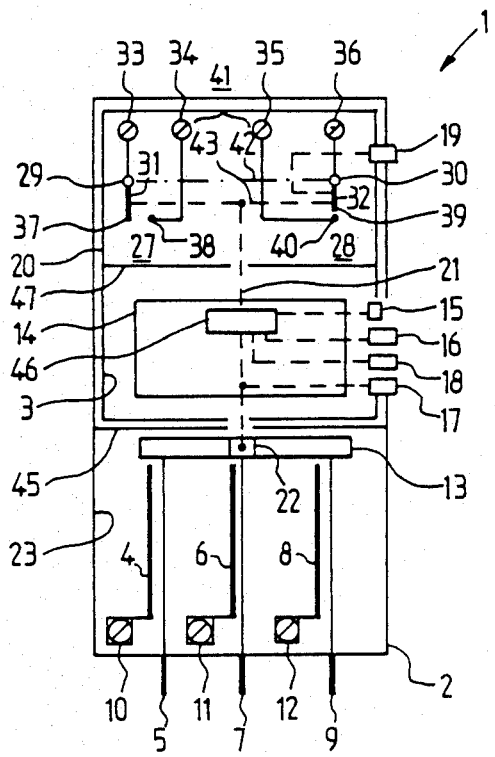
FIG. 1, a general diagram of the thermal relay in which the way in which its main functional elements are geographically separated has been shown.

A thermal relay 1, shown schematically in FIG. 1, comprises an insulating case 2 inside which are formed two cavities 3, 23 separated by a dividing wall 45. In cavity 23 are placed three bi-metallic strips 4, 6, 8 which are connected respectively to input pins 5, 7, 9 and to current output pins 10, 11, 12; the free ends of the bimetallic strips cooperate in a way known per se with a system of parallel strips 13 which is adapted to receive and make use of not only identical deflections of equally heated bi-metallic strips but also different deflections of bi-metallic strips heated dissymmetrically.

In response to current faults flowing through a series connected load, this system 13 transmits a movement through its mechanical output 22 to transmission means 14 disposed on or in a removable assembly 20 which is disposed in cavity 23. Such a system preferably comprises a quick trip device 46, a mechanical means 15 for signalling the states of the latter, an operating mode selector 16 for implementing either an operating mode with manual reset or an operating mode with automatic reset, a test or control member 18 for applyng to the transmission means a mechanical simulation of a current fault and a knob for adjusting the nominal operating current 17.

The mechanical output of this transmission mechanism 46 transmits movements through a linking means 21 to a set of two switches 27, 28 which is for example geometrically separated from the mechanism by a dividing wall 47 of the sub-assembly 20.

A control member such as a separate control push button 19 makes it possible at all times to open switch 28 which is normally closed.

Figure 2:
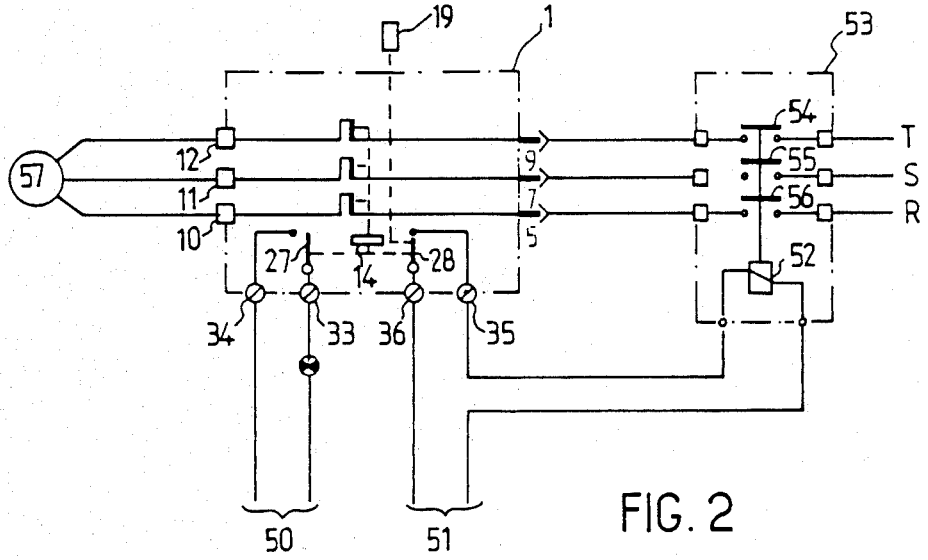
FIG. 2, an electric connection diagram for the relay.

Whether it is separate or not, this set of switches comprises a make switch 27 having connection terminals 33, 34 and a break switch 28 having terminals 35, 36, the first of these being placed for example in a remote signalling circuit 50, and the second being generally placed in series in a control circuit 51 with an electromagnet coil 52 belonging to a contactor 53 whose switches 54, 55, 56 are placed in series with the bimetallic strips and with a motor 57 or other load, see FIG. 2.

Figure 3:
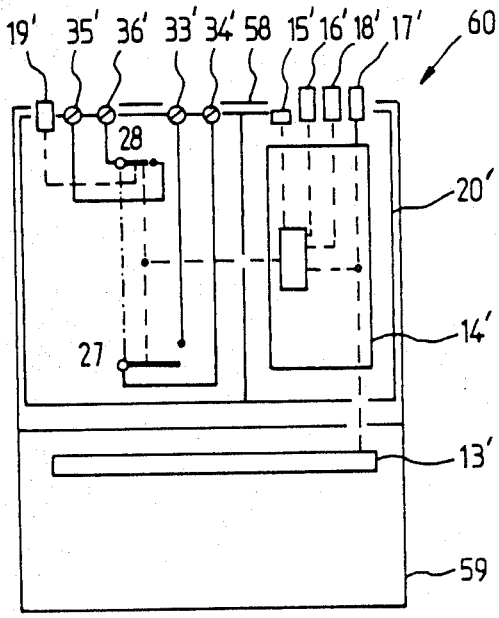
FIG. 3, another general diagram of the relay, showing in a more effective way the arrangement of the functional elements.

In a preferred arrangement 60, shown in FIG. 3, where the same references are used with a sign to show in a more realistic schematical way a thermal relay comparable to the preceding one, the members 15', 16', 17', 18', 19' and terminals 33', 34', 35', 36' of the switches are accessible from the same upper face 58 of the relay case 59.

As will be noted in FIG. 1, the mobile contact pieces 37, 39 of the quick make and break switches 27, 28 cooperating with the fixed contact pieces 38, 40 receive at points 31, 32 the action of connection means 21 of the mechanical output which causes them to effect oscillating movements about pivots 29, respectively 30.

Figure 4:
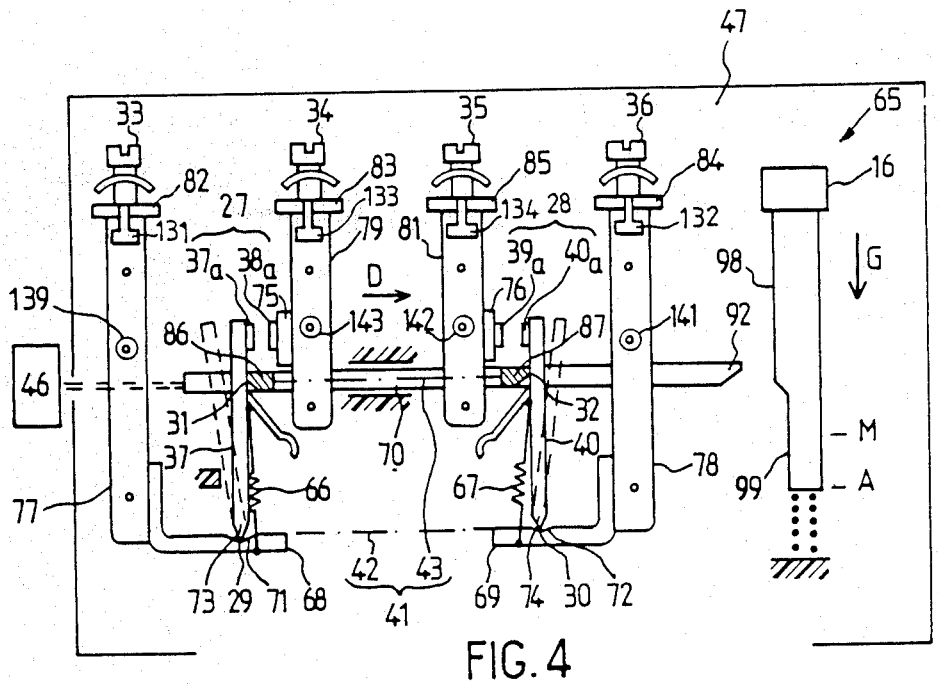
FIG. 4, a front elevational view of the arrangement of the fixed and mobile contact pieces placed on a front face of the dividing wall belonging to a removable sub-assembly.

In the embodiment of the invention shown in FIG. 4, the linking means 21, the points 31 and 32 and the pivots 29, 30 follow substantially the contours of a deformable parallelogram 41 whose fixed base is located at 42 and the mobile parallel base at 43; the deformation comes from the connection between the latter and means 21 are in turn actuated by the quick trip mechanism 46, see FIGS. 1 and 4. It will also be noted in this FIG. 1 that switch 28 may be opened manually at will through the presence of a pusher 19 whose actuation does not cause closure of switch 27; this pusher makes it possible to cause voluntary breaking of the control circuit 51 of contactor 53 associated with the thermal relay 1, see FIG. 2.

Referring to FIG. 4, which corresponds to an intermediate operating phase, it can be seen that the two quick make and break switches 27, 28 each comprise a toggle arrangement using traction springs 66, respectively 67, which are anchored, on the one hand, in brackets 68, respectively 69, in the vicinity of grooves 71, respectively 72, adapted for receiving knife edges 73, respectively 74, disposed at the ends of the lever shaped mobile peices 37, 40 and, on the other hand, are anchored at appropriate points on these levers.

These brackets, as well as brackets 75, 76 which carry the fixed contacts 38, 39, are extending from flat conductors 77, 78, respectively 79, 81, whose opposite ends are curved so as to form electric connection zones 82, 83, respectively 84, 85, for the terminals 33, 34, respectively 35, 36.

A guided strip 70, movable parallel to a plane passing through the knife edges, is placed between two points 31, 32 of the contact levers, one of these points receiving a support force communicated to heel 86 by spring 66 of lever 37 in direction D, whereas the other heel 87 communicates a thrust to lever 40 in the same direction, when mechanism 46 acts in the same direction.

It is clear that when, under the action of mechanism 46, this strip moves in direction D on the appearance of a fault, switch 27 which was open will be closed whereas switch 28 was closed will open.

This simultaneous movement of the strip and of the identical levers 37, 40 communicates to lever 40 not only the striking force which was imparted to the strip by mechanism 46, but also that delivered by spring 66 of lever 37. This arrangement provides then dynamic balancing of the levers, as well as a reduction of the forces to be developed by mechanism 46 for opening switch 28.

It will be further noted that, when strip 70 has not been actuated by mechanism 46, and when lever 37 is therefore in the position illustrated with broken lines, the relative positions of the knife edge, of the spring and of this lever do not confer on the latter a stable position beyond the dead point, this is also true in an opposite direction for lever 40 when the latter takes up its broken line position.

In an advantageous embodiment of the switch device shown in FIGS. 4 and 5, pieces 77, 79, 81, 78 receiving the mobile levers and respectively the fixed contacts 37, 40 are fixed to the surface 89 of a dividing wall 86 belonging to the removable sub-assembly 80 while occupying a volume 92 shown in FIG. 5, whereas terminals 33, 34, 35, 36 are situated in the upper region 87 of the subassembly which is close to the upper region $90_a$ of the case of relay 90.

The striking mechanism 46, comprising a toggle device, as well as strip 70 are disposed against the opposite face 91 of the dividing wall 86 in a volume 93. This latter volume 93 of the sub-assembly is moreover occupied, see FIG. 6, by a mode selector 16 which here consists of an orientable pusher for selecting the operating mode, by the rotary current adjustment member 17 shown with broken lines, a fault simulation pusher 80, the voluntary break push button 19 and a colored part 15 which forms the state indicator and which is carried by a mobile member of mechanism 46.

These different parts are disposed in appropriate housings which are formed between projecting portions of the dividing wall such as 94, 95, 96, 97, see FIG. 6.

Referring to FIG. 4, it can be seen that one end 92 of strip 70 is shown in its movement in direction D opposite a surface with two levels 98, 99 separated by a ramp 65 and belonging to the orientable and sliding pusher (mode selector 16). Depending on whether this pusher is in state or position A, which stops end 92 before the dead point of mechanism 46 is exceeded, or in state M in which this dead point is exceeded in a stable manner, the automatic reset or, respectively, manual reset operating modes are obtained (after cooling of the bi-metallic strips).

Manual resetting is used when, with end 92 in contact with surface 99, a thrust is exerted manually on the mode selector 16 in direction G which, because this end abuts against ramp 65, causes a movement of strip 70 in the direction opposite to D.

In both possible cases of manual or automatic resetting, insufficient cooling of the bi-metallic strips, which does not prevent this movement of this strip, nevertheless prevents the change of state of mechanism 46.

One embodiment 100 of the striking transmission device 14 is shown in FIG. 7, where it can be seen that the rotary current adjustment knob 17 is associated with a cam 101 whose angular position defines that of a compensation bi-metallic strip bent in the form of a V or U, 102, which is pivotally mounted at 103 in the body 104 of the sub-assembly 80 and whose end 105 gives a particular orientation to a support lever 106 pivotally mounted at 107 also in the body.

One end 108 of this support lever carries a pivot pin 109 about which a control lever 110 may pivot one end 111 of which cooperates with the differential strip system 13 for transmitting the movement thereof to an opposite end 112; the latter is placed opposite a transmission lever 113 which is pivotally mounted in the body at 114 and whose end 115 receives one of the ends of a traction spring 116 whose other end is fixed to a bistable rocker 118 which is mounted for pivoting by means of a knife edge 119 in the body. Lever 113 is then placed under permanent traction.

The mobile bistable toggle assembly 46 consequently comprises the members 113, 115, 116, 118 as well as an extension 120 of the rocker 118 the end of which cooperates without play with an appropriate notch 121 formed in strip 70.

An angular movement in direction $\omega$ of the compensation bi-metallic strip 102 resulting from the rotation of knob 17 therefore increases the gap e which separates the end 112 of the control lever 110 and the transmission lever 113, which results in raising the threshold of the tripping current.

As is clear from FIG. 4, the fixed conducting parts 77, 78 and 81, 79 having the brackets 68, 69 or receiving respectively the fixed contacts $38_a$, $39_a$, extend parallel to the direction G and perpendicularly to a direction D which is itself parallel to that of the movement of the strip. These parts are fixed to face 89 for example by means of rivets such as 139, 141, 142, 143 and are aligned by cooperation with studs and/or grooves with body 104 of the sub-assembly 80. Stamped relief and hollow portions of these parts, whose ends will be crimped, can be advantageously substituted for the rivets.

The opposite bent ends 82, 84, respectively 83, 85, of these fixed parts having terminals 33, 36, respectively 34, 35, have inverted T shaped profiles 131, 132, 133, 134, (FIG. 4) which are engaged in adapted housings of corresponding shapes 135, 136, 137, 138 (FIG. 8) which belong to the cavity 3 of case 90 receiving the sub-assembly 80 (FIG. 6) and which are separated by insulating and stiffening dividing walls 144, 145, 146 (FIG. 8).

These measures confer on the sub-assembly not only a precise and stable geometric location with respect to the differential strips 13, themselves carried by the case, but also contribute to solidly securing the terminals thereto so as to remove any possibility of deformation of the fixed parts at the time of screwing these terminals; a lid (not shown) is applied to the sub-assembly for closing cavity 3.

What is claimed is

1. An overload thermal relay comprising:

i. a case having a first partition wall defining first and second cavities, the second cavity having a further partition wall at right angles to the first partition wall.

ii. a plurality of bi-metallic inductive strips housed in said first cavity, iii. a first break switch having a first movable contact support member which has a first pivoting point and a first actuating point, and a first pair of terminals, said break switch having a first operating mode with automatic reset and a second operating mode with manual reset, iv. a second make switch having a second movable contact support member which has a second pivoting point and a second actuating point and a second pair of terminals, v. a movable strip linked to said first and second actuating points and forming with said first and second contact support members and a line which joins said first and second pivoting points a deformable parallellogram, vi. first and second toggle springs respectively connecting said first and second actuating points at a first end thereof, said first and said toggle springs having respective second ends which are fixedly anchored with respect to the case, vii. snap-acting tripping means connecting said bi-metallic strips to said movable strip, and selection means selecting the operating mode of the first switch, said first and second switches are arranged in said second cavity on one side of said further partition wall, while said movable strip, said snap-acting tripping means and said selector means are arranged in said second cavity on the other side of said further partition wall.

2. An overload thermal relay as claimed in claim 1, wherein said first and second pairs of terminals are respectively carried on first and second pairs of elongate conductive members, said elongate conductive members and said first and second movable contact support means extending substantially at right angles to said first partition wall, said elongate conductive members being mounted on said second partition wall, whereas said movable strip is slidably mounted on said second partition wall parallel to said first partition wall.

3. An overload thermal relay as claimed in claim 2, wherein said elongate conductive members have respective first end portions on which said terminals are mounted, said first end portions having folded bent appendixes having a T-shaped cross-section and said case having a wall portion provided with housings in which said bent portions fittingly engage and dividing wall portions between the respective housings.

4. An overload thermal relay as claimed in claim 2, wherein a first elongate conductive member of each of said pairs of terminals is connected to one of said movable contact supports through a bracket having a first branch secured to a second end portion of the elongate conductive member and a second branch at right angles to the first branch, said second branches having grooves which constitute said pivoting points and said second ends of the toggle springs are anchored on said second branches.

* * * * *